US011866882B2

(12) United States Patent
Schurr et al.

(10) Patent No.: US 11,866,882 B2
(45) **Date of Patent: *Jan. 9, 2024**

(54) DRAIN SYSTEM FOR A LAUNDRY APPLIANCE

(71) Applicant: WHIRLPOOL CORPORATION, Benton Harbor, MI (US)

(72) Inventors: Daniel A. Schurr, Wyoming, MI (US); Michael Jon Vriezema, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/968,405

(22) Filed: Oct. 18, 2022

(65) Prior Publication Data

US 2023/0041533 A1 Feb. 9, 2023

Related U.S. Application Data

(62) Division of application No. 16/795,958, filed on Feb. 20, 2020, now Pat. No. 11,530,508, which is a division of application No. 15/656,467, filed on Jul. 21, 2017, now Pat. No. 10,604,882.

(51) Int. Cl.

| | |
|---|---|
| ***D06F 58/24*** | (2006.01) |
| ***D06F 37/02*** | (2006.01) |
| *D06F 58/04* | (2006.01) |

(52) U.S. Cl.

CPC ..... *D06F 58/24* (2013.01); *D06F 37/02* (2013.01); *D06F 58/04* (2013.01)

(58) Field of Classification Search

CPC ..... D06F 58/24

See application file for complete search history.

(56) References Cited

U.S. PATENT DOCUMENTS

| | | | |
|---|---|---|---|
| 3,940,861 | A | 3/1976 | Frazar |
| 7,036,243 | B2 | 5/2006 | Doh et al. |
| 7,121,018 | B2 | 10/2006 | Lee |
| 8,104,192 | B2 | 1/2012 | Myung et al. |
| 8,495,822 | B2 | 7/2013 | Kim et al. |
| 9,134,068 | B2 | 9/2015 | Choi |
| 9,488,412 | B2 | 11/2016 | Yu et al. |
| 10,604,882 | B2 | 3/2020 | Schurr et al. |
| 2010/0192397 | A1 | 8/2010 | Kim et al. |
| 2013/0198970 | A1 | 8/2013 | Doh et al. |
| 2020/0199803 | A1 | 6/2020 | Schurr et al. |

FOREIGN PATENT DOCUMENTS

| | | |
|---|---|---|
| DE | 102007052835 | 5/2009 |
| DE | 102012209826 | 12/2013 |
| EP | 2471994 | 7/2012 |
| JP | 2014150997 | 8/2014 |

*Primary Examiner* — Jason Y Ko

(74) *Attorney, Agent, or Firm* — Price Heneveld LLP

(57) ABSTRACT

A drain system for a laundry appliance is provided. The laundry appliance may be configured as a clothes dryer having a heat exchanger to cool and condense moisture-laden air received from the laundry drum. The drain system utilizes a drain structure to catch condensate from the heat exchanger and evacuate the condensate to a sump area. A blower and blower channel moves the dry air from the heat exchanger back to the drum. To prevent negative pressure in the blower channel from moving the condensate to the sump area, an air channel between the blower channel and sump area provides air flow communication.

20 Claims, 10 Drawing Sheets

DRAIN SYSTEM FOR A LAUNDRY APPLIANCE

CROSS-REFERENCE TO RELATED APPLICATION

The present application is a divisional of and claims priority to U.S. patent application Ser. No. 16/795,958, filed Feb. 20, 2020, now U.S. Pat. No. 11,530,508, which is a divisional of and claims priority to U.S. patent application Ser. No. 15/656,467, now U.S. Pat. No. 10,604,882, filed Jul. 21, 2017, both of which are entitled DRAIN SYSTEM FOR A LAUNDRY APPLIANCE, the entire disclosures of which are hereby incorporated herein by reference.

TECHNICAL FIELD

The disclosure generally relates to the field of laundry appliances, and specifically, to a drain system for a laundry appliance that utilizes a heat exchanger for drying and recirculating air for processing laundry.

SUMMARY

According to an aspect, the disclosure provides a drain system for a laundry appliance. The laundry appliance includes a drum for processing laundry, a heat exchanger to cool and condense moisture-laden air received from the drum, and a blower channel for moving dry air from the heat exchanger to the drum. The drain system includes a drain ramp disposed under the heat exchanger, and is configured to receive condensate from the heat exchanger. The drain system further includes a sump area connected to the drain ramp for collecting the condensate and an air channel extending from the sump area to the blower channel. The air channel is configured to provide air flow communication between the sump area and the blower channel.

According to another aspect the disclosure provides a drying appliance that includes a drum for processing laundry, a heat exchanger to cool and condense moisture-laden air received from the drum and a blower channel for moving dry air from the heat exchanger to the drum. The drying appliance further includes a drain structure disposed under the heat exchanger, and is configured to receive and evacuate condensate from the heat exchanger to a sump area. The sump area is connected to the drain structure for collecting the condensate. Further, the drain structure includes an air channel extending from the sump area to the blower channel, which is configured to provide air flow communication between the sump area and the blower channel.

Additionally, the disclosure provides a base structure for a drying appliance that includes a drain ramp configured to evacuate condensate from a heat exchanger, and a sump area connected to the drain ramp for collecting the evacuated condensate. The base structure further includes a blower passage that is configured to move dry air from the heat exchanger, and an air channel extending from the sump area to the blower passage to provide air flow communication between the sump area and the blower passage.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description, will be better understood when read in conjunction with the appended drawings. For the purpose of illustrating the present disclosure, there are shown in the drawings, certain embodiment(s) which are presently preferred. It should be understood, however, that the disclosure is not limited to the precise arrangements and instrumentalities shown. Drawings are not necessary to scale. Certain features of the disclosure may be exaggerated in scale or shown in schematic form in the interest of clarity and conciseness.

DETAILED DESCRIPTION

Figure 1:
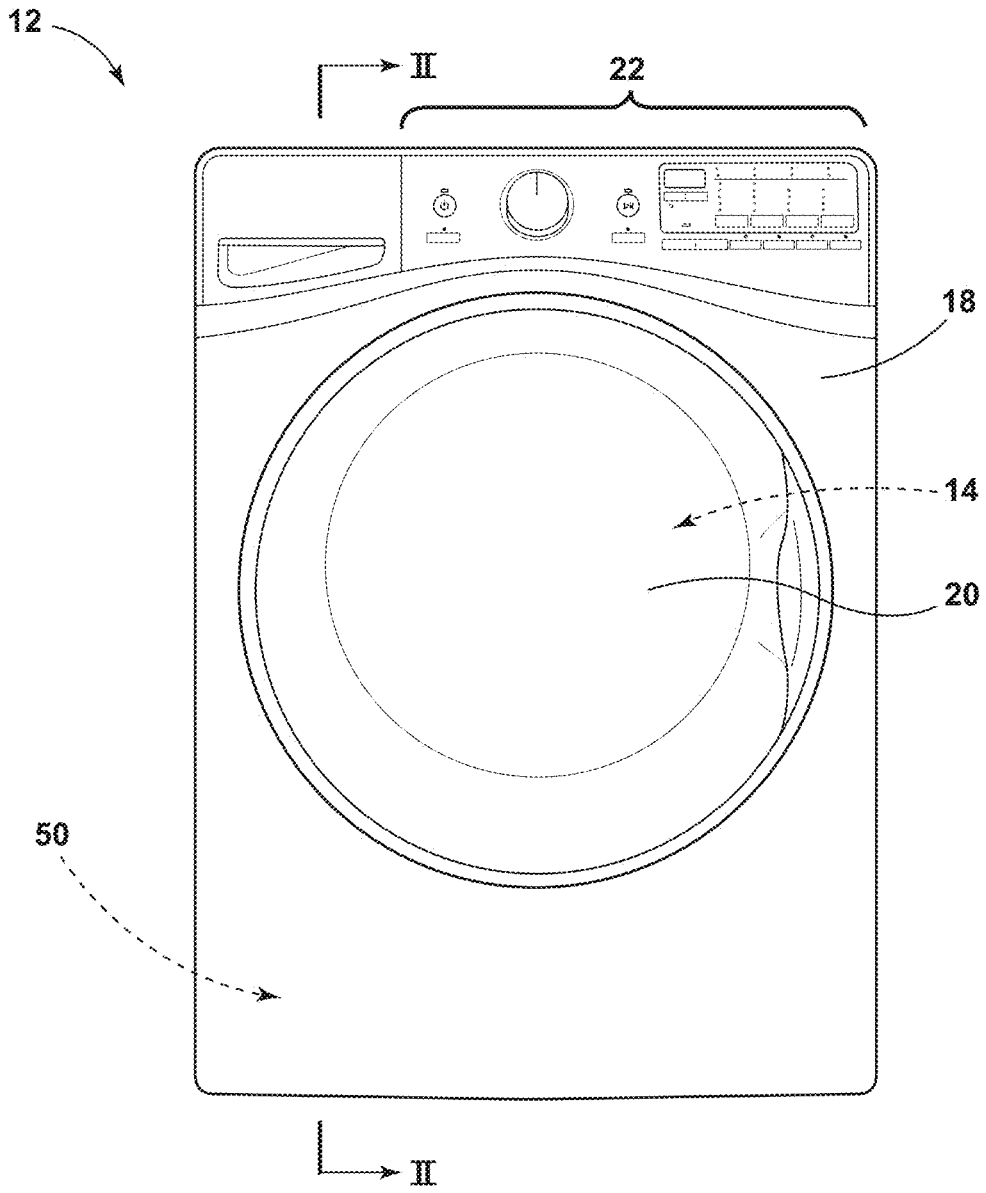
FIG. 1 is a front elevational view of a laundry appliance, according to an embodiment of the present disclosure.

The present disclosure provides various structures and components for a drain system for a laundry appliance, such as laundry drying appliance 12 shown in the illustrated embodiment. According to aspects described herein, the drain system may include structures to facilitate the movement and evacuation of condensate received from one or more heat exchangers to a sump area contained in laundry appliance 12.

As described in more detail below with respect to the attached FIGS. 1-9B, according to various embodiments, the laundry appliance 12 may include a drum 14 for processing laundry articles 16 and one or more heat exchangers 30 to cool and condense moisture-laden process air 28 received from the drum 14, producing condensate 36, and then to subsequently heat and return the process air 28 to the drum 14 for drying laundry articles 16. Because of the continuous movement of the process air 28 across the heat exchangers 30, areas of negative pressure or air vacuums may result. Accordingly, to counteract undesirable effects of the negative pressure areas, such as the reverse flow of condensate 36, i.e. in reverse flow direction 44, back toward the flow direction of process air 28, the laundry appliance 12 may include components or structures to reduce or alleviate the negative pressure areas. In at least one case, a laundry appliance 12 includes an air channel 70 extending from a sump area 64 which collects condensate 36, to a blower channel 66, which returns the process air 28 to the drum 14. The air channel 70 may be configured to provide air flow communication between the sump area 64 and the blower channel 66 to relieve the negative pressure and facilitate movement of the condensate 36 to the sump area 64.

Accordingly, the present illustrated embodiments reside primarily in combinations of apparatus components and method steps related to a drain system for a laundry appliance. The apparatus components and method steps have been represented, where appropriate, by conventional symbols in the drawings, showing only those specific details that are pertinent to understanding the embodiments of the present disclosure. Further, like numerals in the description and drawings represent like elements.

Figure 2:
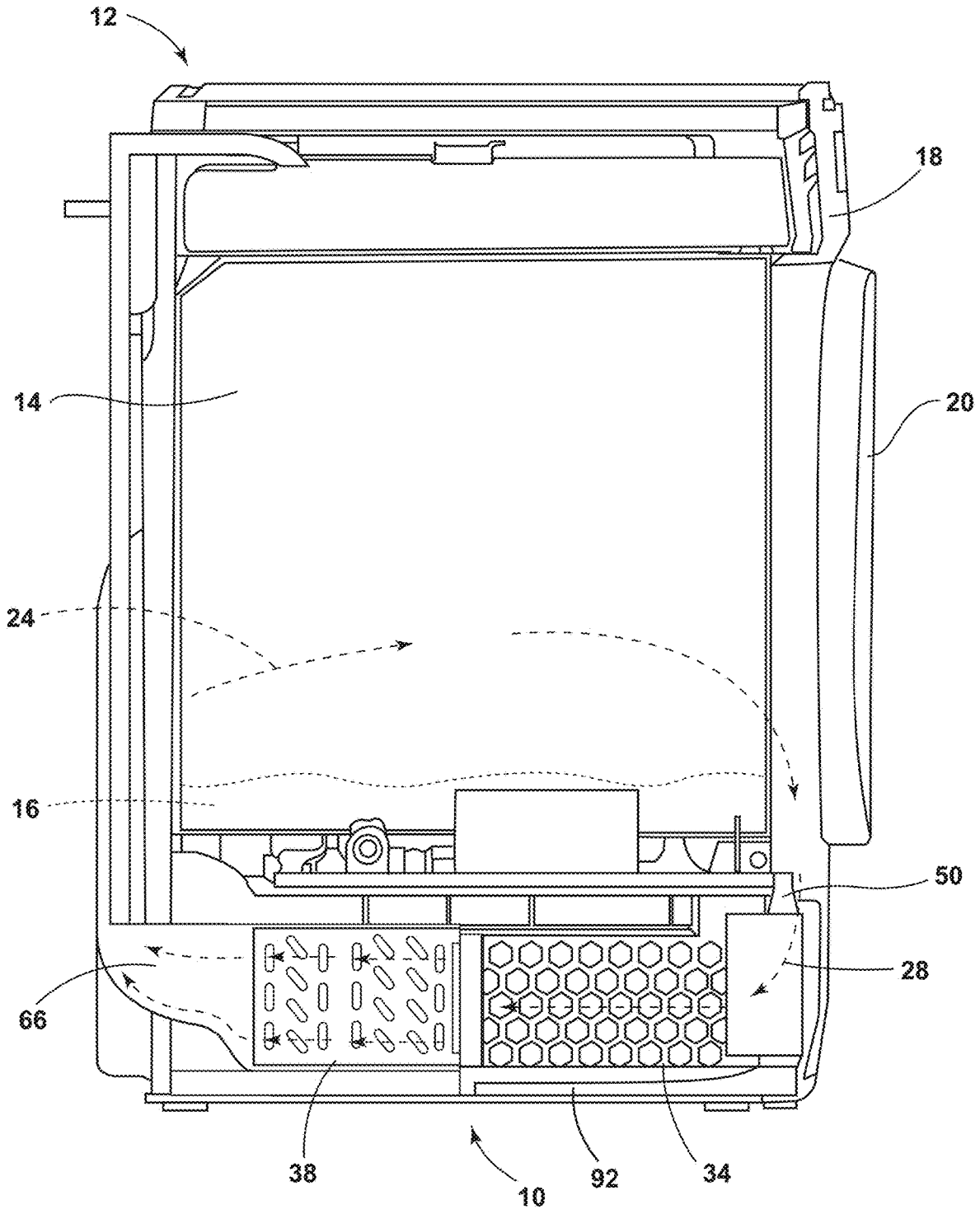
FIG. 2 is a cross-sectional view of the laundry appliance taken along line II of FIG. 1.
Figure 3:
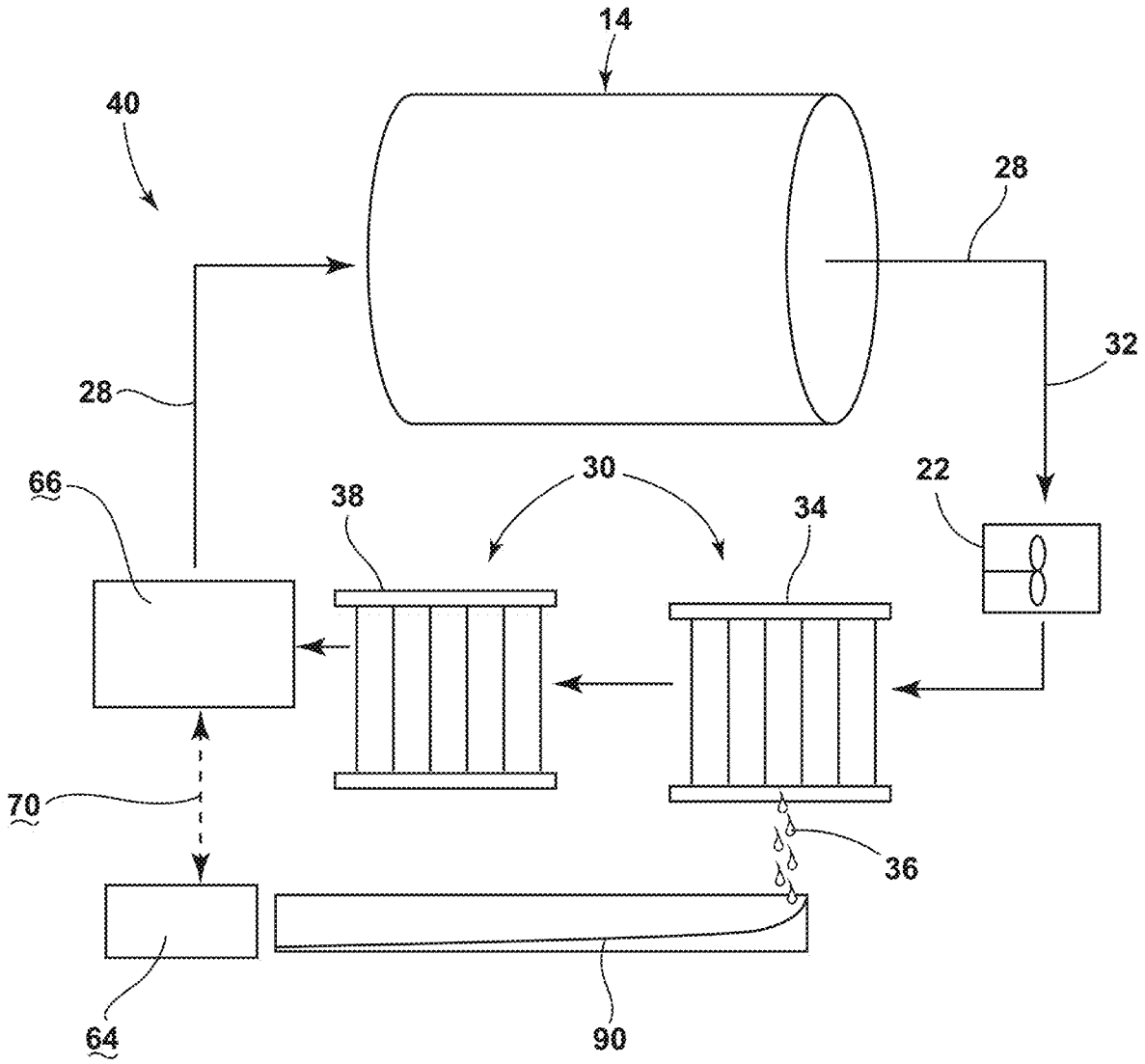
FIG. 3 is a schematic diagram of a drying function, according to an embodiment of the present disclosure.

FIGS. 1-3 depict an exemplary laundry appliance 12 on which embodiments of the presently disclosed drain system may be used. The laundry appliance 12, typically a laundry drying apparatus, can include a drum 14 for processing laundry articles 16 contained therein. The drum 14 may be rotationally operable within a cabinet 18 that serves as a housing for the components of the laundry appliance 12. Laundry appliance 12 may further include a door 20 for accessing drum 14 and one or more controls 22 for initiating a drying function 40 of laundry appliance 12.

FIG. 3 depicts a simplified schematic of a heat pump system 10 for carrying out a drying function 40, as may be implemented in laundry appliance 12. To facilitate drying, an airflow path 24 is included within the cabinet 18 and includes a blower 26 that moves process air 28 through airflow path 24 and also through the drum 14. Accordingly, process air 28 can be moved through the drum 14 for drying or otherwise processing damp or wet laundry articles 16 that may be contained within the drum 14. The heat pump system 10 is at least partially positioned within the airflow path 24. The heat pump system 10 can include at least one heat exchanger 30 that receives process air 28 from the drum 14 through operation of the blower 26. The blower 26 can be located upstream of the heat exchangers 30 such that operation of the blower 26 pushes the process air 28 toward and through the heat exchangers 30. The blower 26 can also be located downstream of the heat exchangers 30, such as between a blower channel 66 and drum 14. In this configuration, operation of the blower 26 draws the process air 28 through the heat exchangers 30 and back into drum 14. In other configurations, one or more blowers 26 may be located either upstream or downstream of the heat exchangers 30. There may also be multiple blowers 26 that can be located both upstream and downstream of the heat exchangers 30.

Referring again to FIGS. 1-3, and specifically to the simplified schematic of FIG. 3, during a performance of a drying function 40 of the appliance 12, a heat exchanger 30, typically an evaporator 34, can receive moisture-laden air 32 from the drum 14. As known in the art, the evaporator 34 can serve to reduce the temperature of the moisture-laden air 32. By reducing the temperature of the moisture-laden air 32, the process air 28 is dehumidified and condensate 36 is precipitated out of the moisture-laden air 32. Once precipitated and subject to gravity, condensate 36 may fall from the evaporator 34. A drain structure, such as a channel or drain ramp 90, may be positioned below evaporator 34 and serve to capture the condensate 36. After the condensate 36 has been removed, the now dehumidified process air 28 continues through the airflow path 24 back to the drum 14 to facilitate the drying function 40 of the laundry appliance 12.

According to some embodiments, the heat pump system 10 may also include a condenser 38 disposed downstream of evaporator 34 that serves to heat the dehumidified process air 28 after it has moved through the evaporator 34. After the process air 28 is heated, blower 26 facilitates the movement of process air 28 along a blower channel 66, directed back into drum 14. Accordingly, the heat pump system 10 can serve to modify the temperature of the process air 28 to perform various cooling and heating operations through use of an evaporator 34 and a condenser 38, respectively, to dry damp laundry articles 16 contained within drum 14. Of course, it will be understood that modifications may be made to the various embodiments described herein, as would be contemplated in the art. For example, other types of heat exchange processes may be incorporated, including but not limited to, additional heaters, such as electric resistance or gas heaters, to modify the temperature of the process air 28.

As exemplified in the illustrated embodiment of FIGS. 1-3, after the condensate 36 is removed from the moisture-laden air 32, drain ramp 90 may serve to evacuate the condensate 36. In some cases, the condensate 36 may be delivered to a separate area for removal from laundry appliance 12. In other cases, the condensate 36 may be recycled within laundry appliance 12 for other purposes, such as cleaning of internal filters or for cooling internal components. In at least one case, as described in more detail below with respect to the illustrated embodiment, drain ramp 90 may serve to deliver condensate 36 to sump area 64 for further evacuation. In the illustrated embodiment, sump area 64 is configured as a contained area within laundry appliance 12 for collection of discarded liquid, such as condensate 36. Sump area 64 may also include various other components such as pumps, cups for removing condensate, and various other structures as would be known in the art. In such embodiments, laundry appliance 12 may allow for removal or reuse of the liquid in sump area 64. In other cases, however, sump area 64 may be configured as an external drain or device that serves to move condensate 36 and other material out of laundry appliance 12. Again, these and other possible modifications would be readily contemplated by a skilled artisan.

Figure 4:
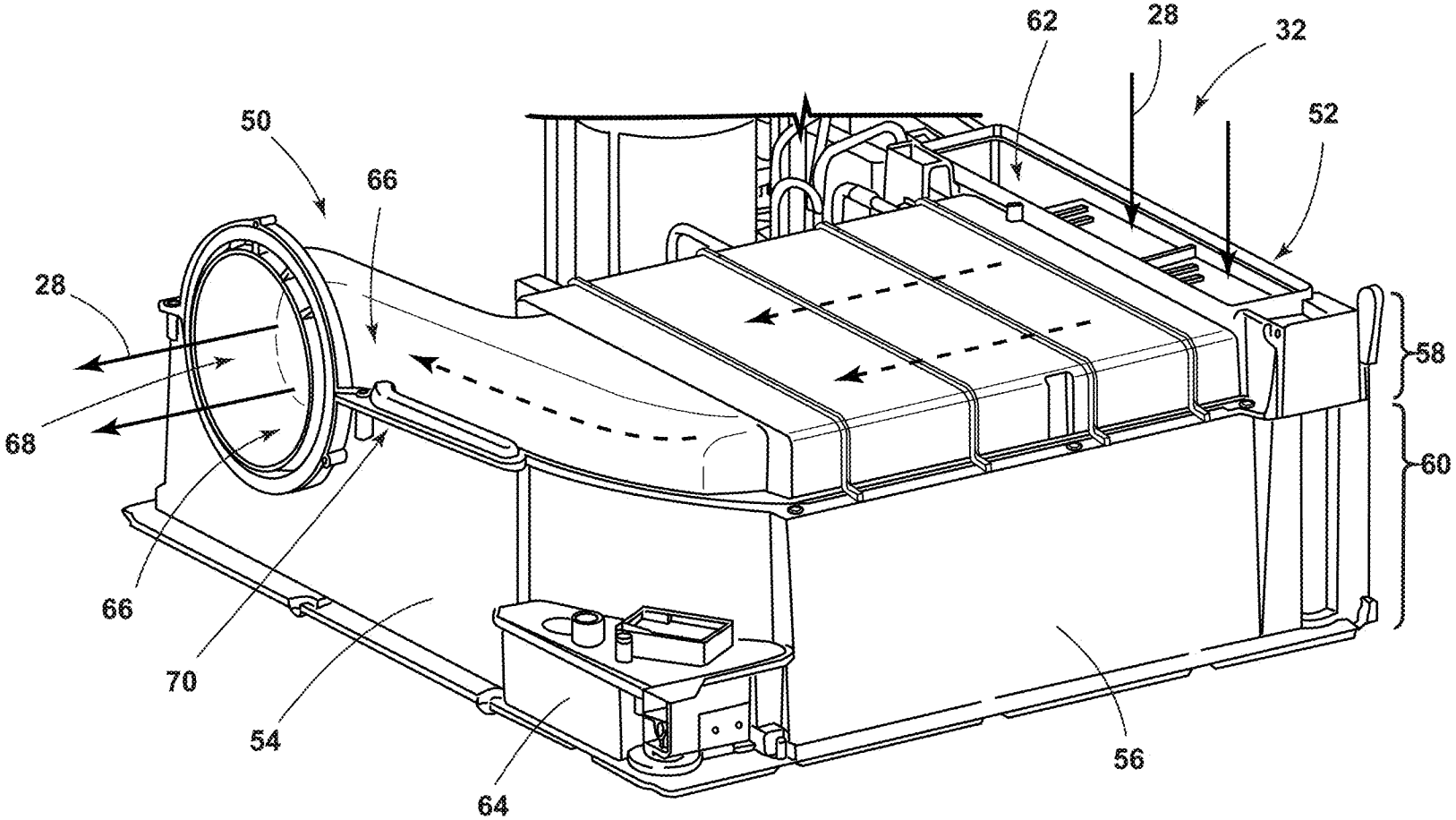
FIG. 4 is a top perspective view of a base structure of the laundry appliance, according to an embodiment of the present disclosure.
Figure 5:
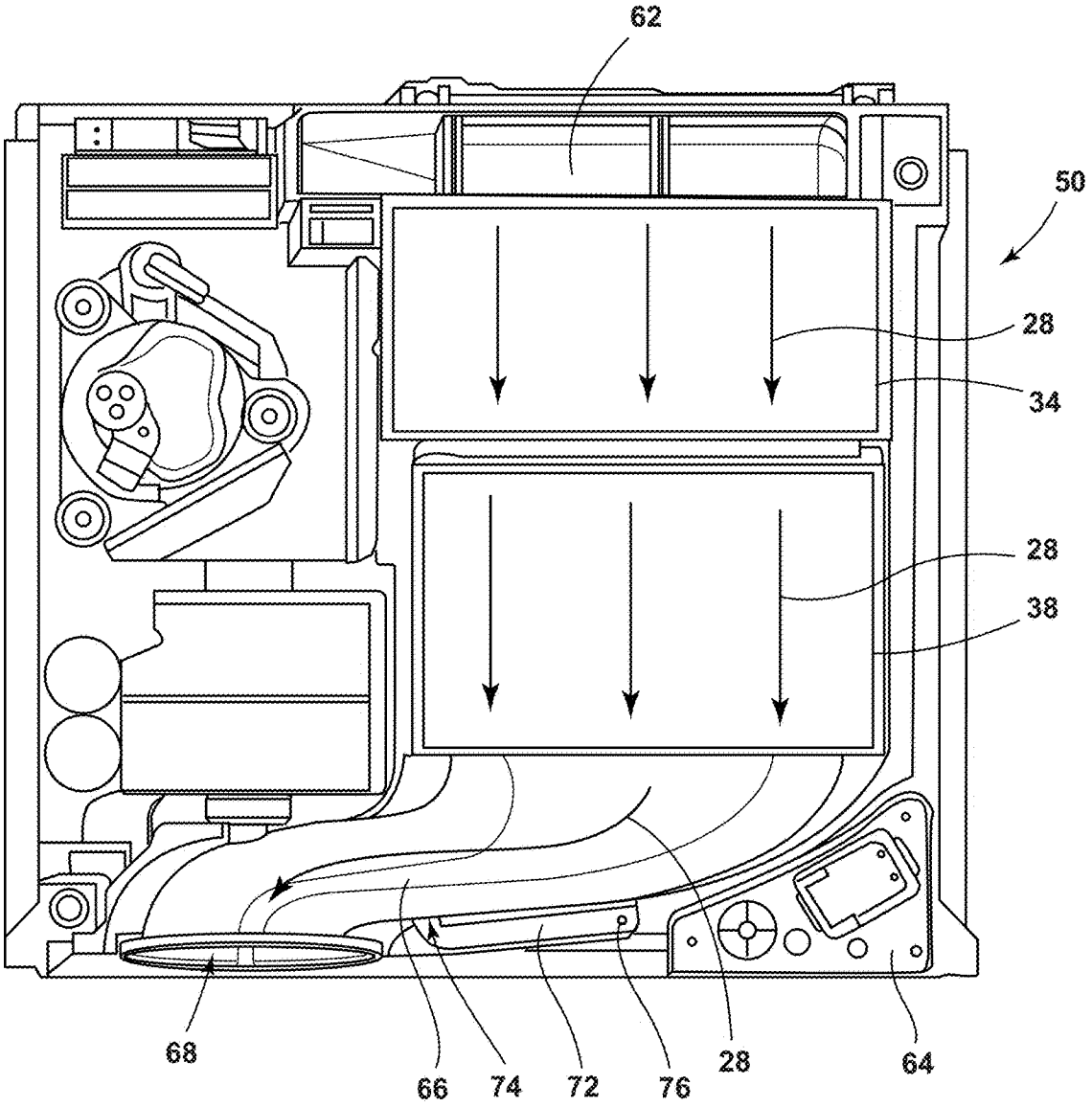
FIG. 5 is a top plan view of the base structure, according to an embodiment of the present disclosure.
Figure 6:
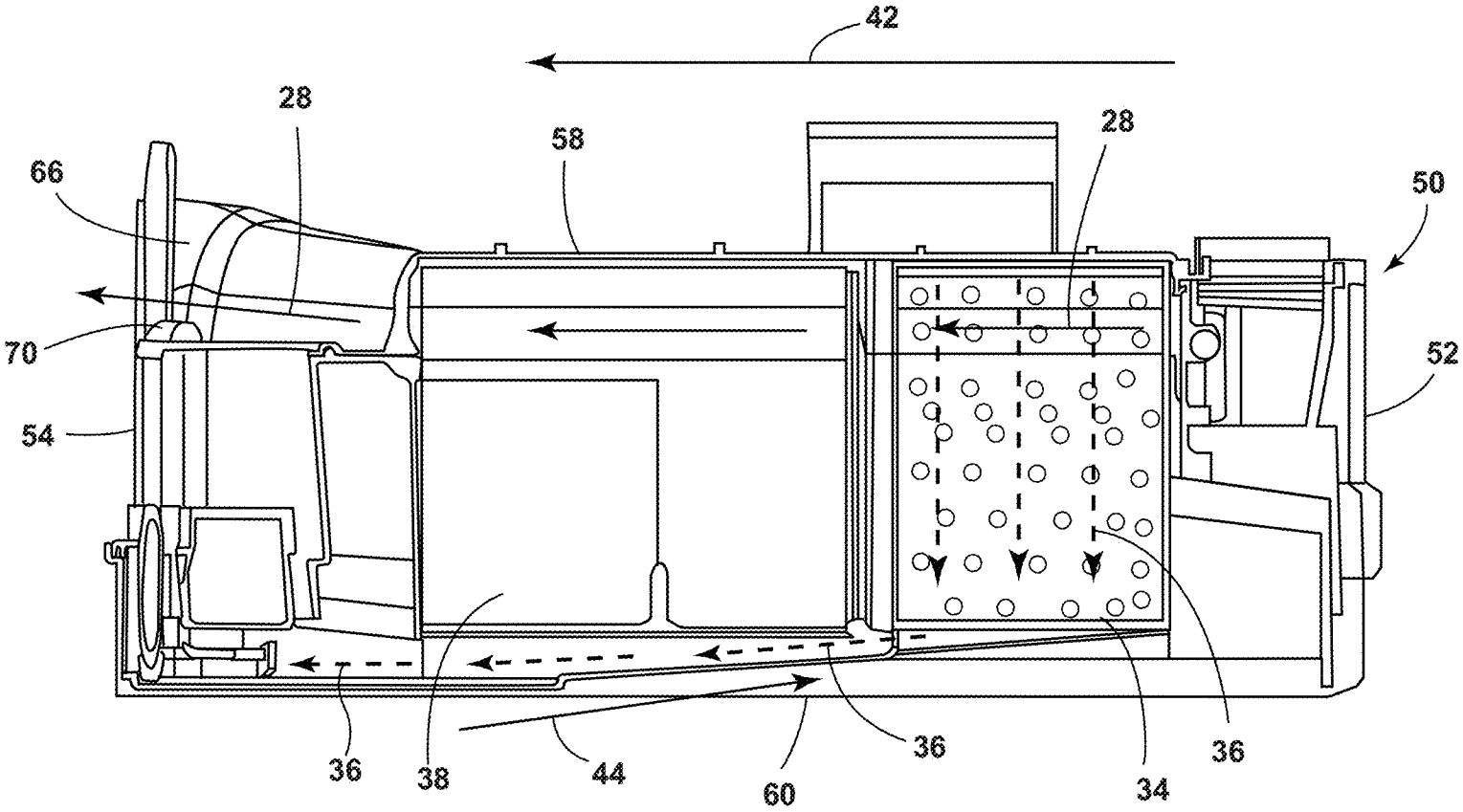
FIG. 6 is a partial side elevational view of the base structure, according to an embodiment of the present disclosure.

FIGS. 4-6 depict various views of an exemplary base structure 50 of laundry appliance 12 according to an embodiment described herein. According to the illustrated embodiment, base structure 50 forms a bottom portion of laundry appliance 12 and may house one or more components of heat pump system 10, such as evaporator 34, condenser 38, blower channel 66 and sump area 64. As depicted, base structure 50 includes a front side 52 disposed at a front of laundry appliance 12, a rear side 54, disposed opposite front side 52, and side portions 56. Base structure 50 may also include a top surface, or top portion 58, and a bottom surface, or bottom portion 60. In some cases top portion 58 and bottom portion 60 may be separately formed and coupled together. Each of top portion 58 and bottom portion 60 may also structurally define various components of heat pump system 10. Referring to FIG. 4, top portion 58 may define an air inlet 62 where process air 28 enters base structure 50. Top portion 58 may also define at least a portion of air outlet 68 where process air 28 exits base structure 50. As shown in the figures, top portion 58 may also define a portion of blower channel 66 as well as a portion of air channel 70 (as described in more detail below). FIG. 5 depicts base structure 50 with top portion 58 removed, revealing various components, such as evaporator 34 and condenser 38 contained therein. FIG. 6 depicts a side view of base structure 50 with side portion 56 removed.

Figure 7:
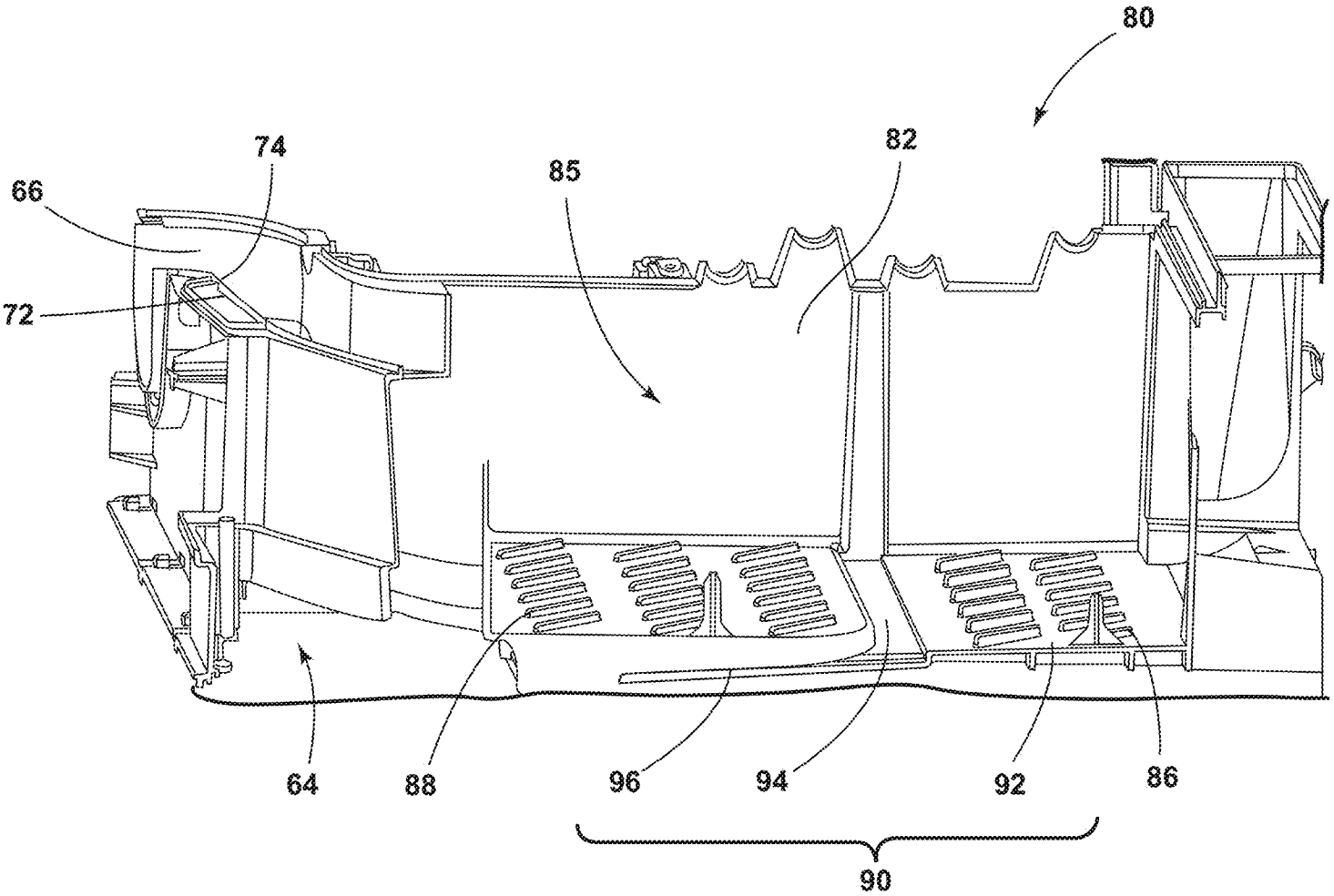
FIG. 7 is a partial top perspective view of the base structure, according to an embodiment of the present disclosure.
Figure 8:
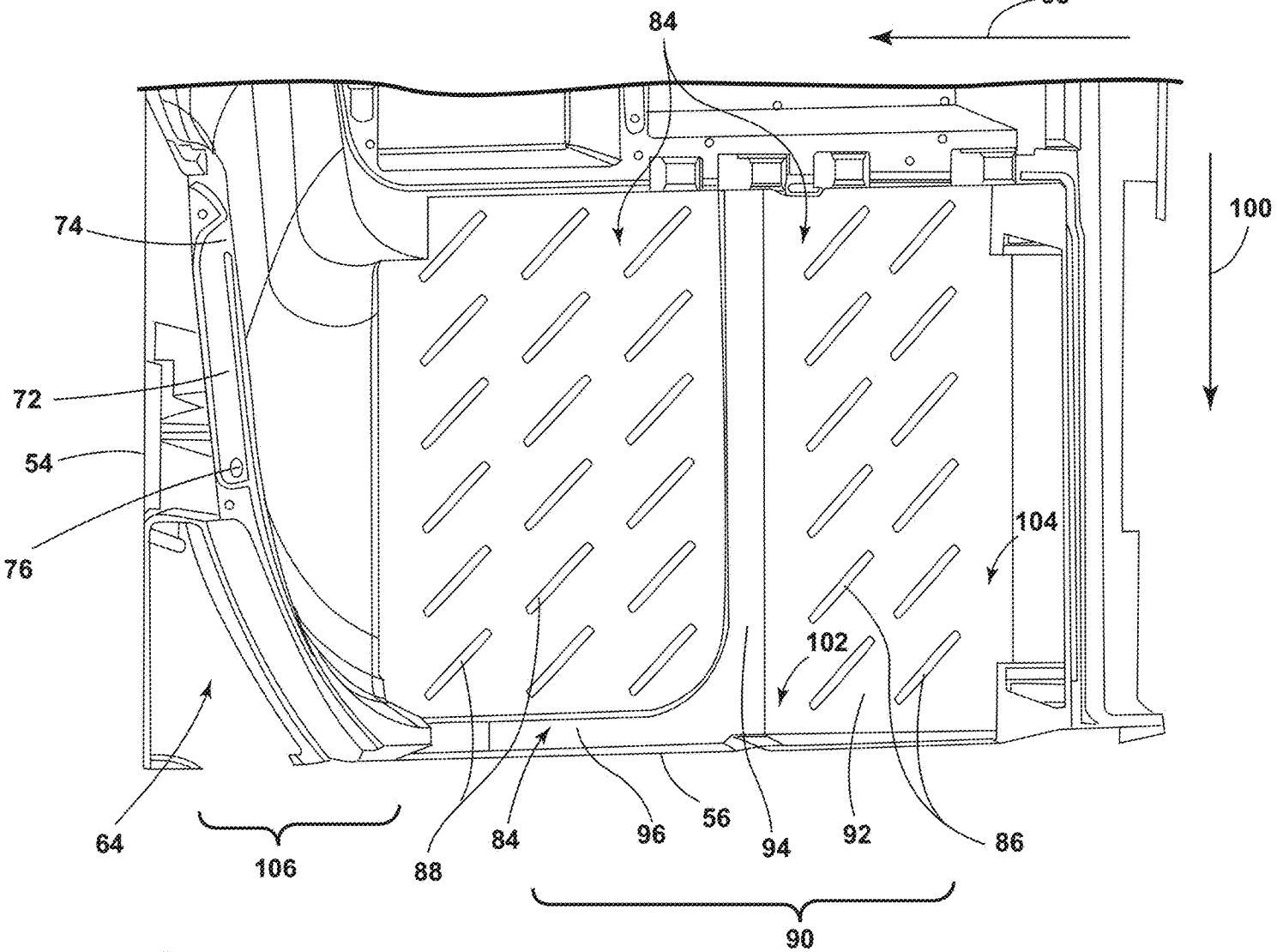
FIG. 8 is a partial top plan view of the base structure, according to an embodiment of the present disclosure.

FIGS. 7 and 8 illustrate a top perspective view and a top plan view, respectively, of a lower base portion 80, forming at least a part of bottom portion 60. In the illustrated embodiment, lower base portion 80 includes at least one side surface 82 and a bottom surface 84, which, at least partially, define an open area 85. Open area 85 may be configured to hold one or more components of heat pump system 10. In at least one case, open area 85 may provide structural support for evaporator 34 and condenser 38. Referring to FIGS. 7 and 8, bottom surface 84 includes a first set of supporting structures, evaporator support structures 86, for supporting evaporator 34. In some embodiments, evaporator support structures 86 may extend up from bottom surface 84 to provide space between evaporator 34 and bottom surface 84, allowing for condensate 36 to fall to bottom surface 84, described in more detail below. Similarly, bottom surface 84 includes a second set of supporting structures, condenser support structures 88, for supporting condenser 38. Condenser support structures 88 may also extend up from bottom surface 84 to provide space between condenser 38 and bottom surface 84. As shown in the illustrated embodiment, evaporator support structures 86 and condenser support structures 88 may be elongated structures that are integrally formed with lower base portion 80. In other embodiments, however, the supporting structures may be separate elements attached to bottom surface 84 or coupled with evaporator 34 or condenser 38. In still other embodiments, evaporator 34 and condenser 38 may be supported in other ways contemplated by a skilled artisan, such as by mechanical fasteners or other structural means.

Base structure 50 may also include provisions to facilitate the draining and evacuation of condensate 36 from evaporator 34. For example, in some embodiments, base structure 50 may include one or more drain structures, channels, or ramps to move condensate 36 to a sump area 64 for evacuation from or reuse in laundry appliance 12. In at least one case, lower base portion 80, forming at least a portion of base structure 50, may be configured to define a gravity-assisted drain system for evacuating condensate 36. In some embodiments, a bottom surface, such as bottom surface 84, may be structured to include one or more integrally formed sloped surfaces or channels that collectively form a drain system, such as drain ramp, facilitating the movement of condensate 36 toward sump area 64. According to aspects described herein, the one or more sloped surfaces may be sloped to encourage the movement of condensate 36 toward sump area 64. In some cases, the drain ramp may include only one sloped surface that is sloped downward from heat exchangers 30 to sump area 64. In other cases, a drain ramp may include multiple sloped surfaces, either sloped in the same direction or in different directions. For example, a drain ramp may include a plurality of separate, sloped, surfaces that are all sloped in the same direction, or may include a first sloped surface that is sloped in a first direction and a second sloped surface that is sloped in a second direction.

In at least one case, referring to the illustrated embodiment, a drain ramp 90 includes a first sloped surface 92, sloped in a first direction 98 toward rear side 54, and a second sloped surface 94, sloped in a second direction 100 toward side portion 56. Drain ramp 90 also includes a sloped channel 96 extending in first direction 98. In some embodiments, first direction 98 may be substantially perpendicular to second direction 100. In other embodiments, the directions may be substantially the similar or angled less than 90 degrees with respect to each other. Referring to drain ramp 90 of FIGS. 7-8, first sloped surface 92 may be positioned directly beneath evaporator 34, integral with evaporator support structures 86. Second sloped surface 94 may be disposed between first sloped surface 92 and condenser support structures 88. Further, sloped channel 96 may be disposed proximate side portion 56 of base structure 50, and terminate at or near sump area 64. As described above, first sloped surface 92 may slope downward in a first direction 98 from front side 52 toward rear side 54 of laundry appliance 12. First sloped surface 92 may also slope downward toward second sloped surface 94. Second sloped surface 94 may be lower than first sloped surface 92 and slope downward in a second direction 100 toward side portion 56 of base structure 50, as well as toward sloped channel 96. Sloped channel 96 may be disposed along side portion 56, and may also slope downward along side portion 56 in first direction 98 from a low area 102 of first sloped surface 92 toward sump area 64. In general, drain ramp 90 may be structured such that a highest area 104 is disposed beneath evaporator 34 and a lowest area 106 is disposed at or near sump area 64. Accordingly, when condensate 36 drains down evaporator 34 (FIG. 6), first sloped surface 92 directs condensate 36 toward second sloped surface 94, and second sloped surface 94 directs condensate 36 toward sloped channel 96. Sloped channel 96 ultimately directs condensate 36 toward sump area 64.

As previously described with reference to FIG. 6, process air 28 may enter base structure 50 through an air inlet 62 proximate front side 52, move through heat exchangers 30, i.e. evaporator 34 and condenser 38, down blower channel 66 and then exit the air outlet 68 disposed proximate rear side 54. This continuous movement of process air 28 across base structure 50 along direction 42 may create a negative pressure or vacuum ultimately causing condensate 36 to move against a natural gravity-assisted pull. For example, in at least one embodiment illustrated in FIG. 6, the negative pressure may cause condensate 36 to move up sloped channel 96, as indicated by reverse flow direction 44, instead of down sloped channel 96 towards sump area 64.

According to aspects described herein, base structure 50 includes one or more provisions to prevent the negative pressure or vacuum effect and to facilitate evacuation of condensate 36 down drain ramp 90 toward sump area 64, instead of in a reverse flow direction 44. Specifically, in some embodiments, base structure 50 may include one or more channels, apertures or openings at air outlet 68 to release pressure. For example, in some cases, an aperture may be formed between blower channel 66 and sump area 64 to facilitate the communication of air flow and relieve the negative pressure that is created. In at least one case, base structure 50 defines an air channel 70 between blower channel 66 and sump area 64 to facilitate this process.

Figure 9A:
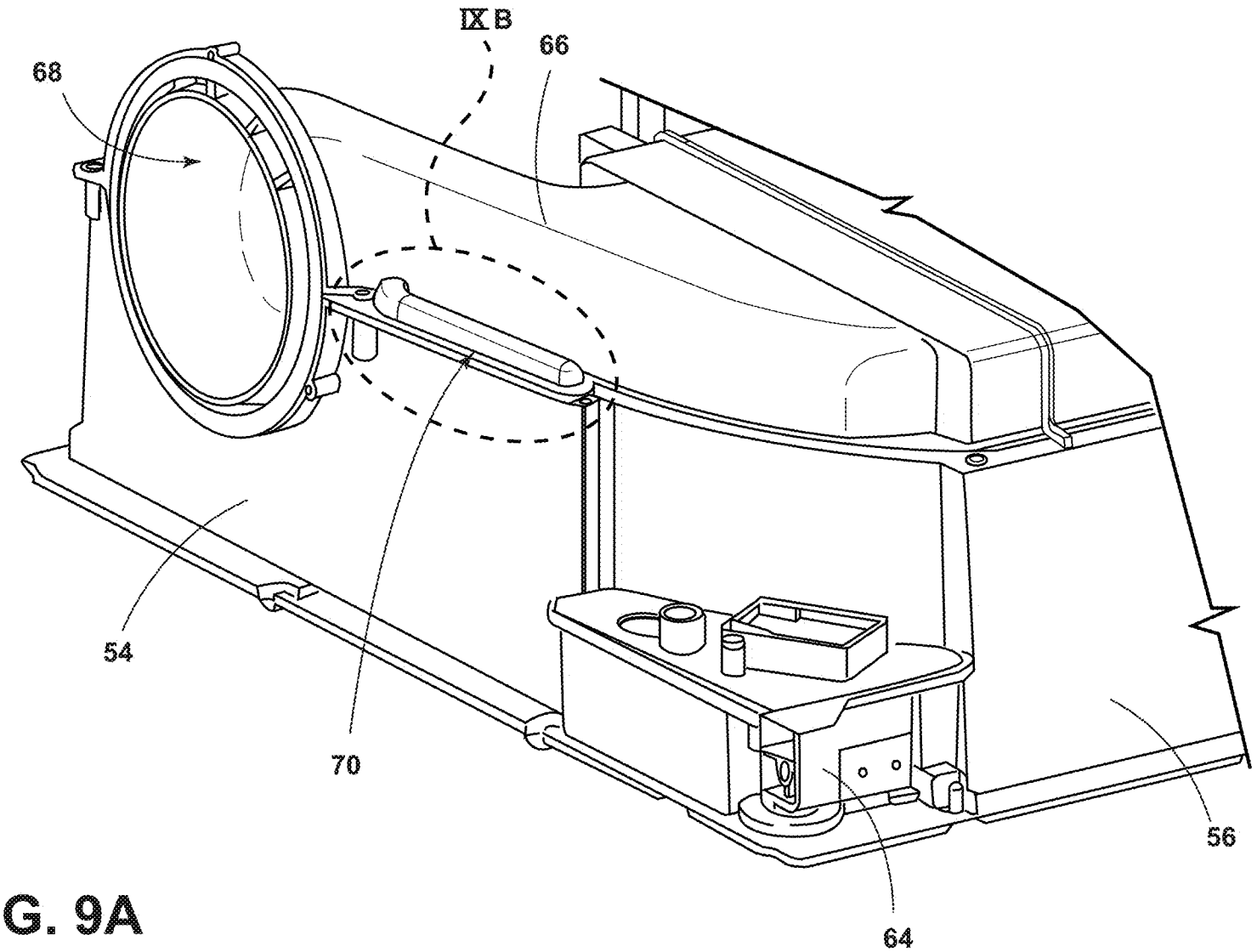
FIG. 9A is a partial top perspective view of the base structure, according to an embodiment of the present disclosure.
Figure 9B:
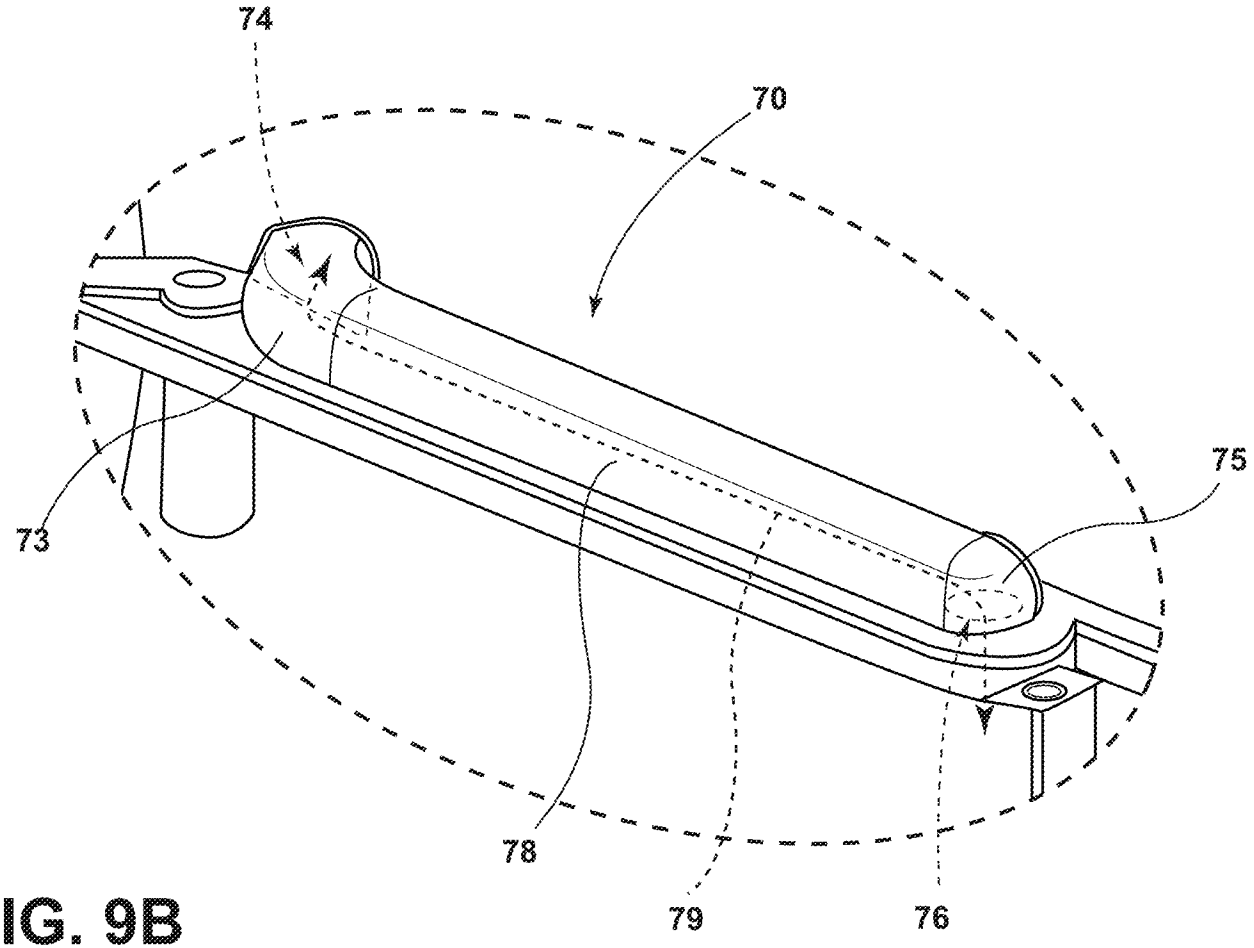
FIG. 9B is an exploded partial top perspective view of a portion of the base structure, according to an embodiment of the present disclosure.

Referring to FIGS. 9A and 9B, according to an embodiment, air channel 70 may be configured as an elongated labyrinth-like structure along portions of base structure 50 to connect blower channel 66 with sump area 64 and provide for air flow communication between blower channel 66 and sump area 64. Specifically, air channel 70 may include a first terminal end 73 having an opening or pass-through to the blower channel 66, i.e. blower channel entrance 74, and a second terminal end 75 having an opening or pass-through to the sump area, i.e. sump area aperture 76, defined therein. Air channel 70 may include a bottom portion 72 defined on lower base portion 80 (FIG. 8) and a top portion 78 formed on top portion 58 of overall base structure 50. When coupled together, top portion 58 and bottom portion 60 may define air channel 70. Thus, according to an embodiment, air channel 70 may include an elongated open tunnel connecting blower channel 66 with sump area 64 for air flow communication. In operation, air channel 70 serves to relieve the negative pressure created by process air 28 moving across base structure 50. More specifically, negative pressure relief stream 79 may serve to reduce the negative pressure across base structure 50, and particularly near blower channel entrance 74, to prevent the reverse flow of condensate 36 up drain ramp 90, indicated as reverse flow direction 44.

Of course those skilled in the art will appreciate that the illustrated embodiment of air channel 70 is only one configuration of structures for preventing the reverse flow of condensate, and will readily appreciate the many of variations that may be made to the disclosed structures and still fall within the spirit and scope of the present disclosure. For example, air channel 70 may have inlets and/or entrances to blower channel 66 at other locations on blower channel 66, and may have an inlet to other areas along sump area 64 and/or along drain ramp 90. These and other modifications will be understood and readily made by those skilled in the art.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. For example, an element proceeded by "comprises a . . . " does not, without more constraints, preclude the existence of additional identical elements in the process, method, article, or apparatus that comprises the element.

For purposes of this disclosure, the term "coupled" (in all of its forms, couple, coupling, coupled, etc.) generally means the joining of two components directly or indirectly to one another. Such joining may be stationary in nature or movable in nature. Such joining may be achieved with the two components and any additional intermediate members being integrally formed as a single unitary body with one another or with the two components. Such joining may be permanent in nature or may be removable or releasable in nature unless otherwise stated.

It is important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the spirit and scope of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

The invention claimed is:

1. A base structure for a drying appliance comprising:
- a drain ramp, the drain ramp configured to evacuate condensate from a heat exchanger;
- a sump area connected to the drain ramp for collecting the evacuated condensate;
- a blower passage, wherein the blower passage is configured to move dry air from the heat exchanger; and
- an air channel extending from the sump area to the blower passage, wherein the air channel is configured to provide air flow communication between the sump area and the blower passage.

2. The base structure of claim 1, wherein the air channel comprises:
- a first terminal end at an opening in the blower passage; and
- a second terminal end at an opening in the sump area.

3. The base structure of claim 1, wherein the air channel comprises:
- a bottom surface having an aperture forming a pass-through to the sump area; and
- a top surface forming a pass-through to the blower passage.

4. The base structure of claim 1, wherein the drain ramp comprises:
- a high end proximate the heat exchanger; and
- a low end proximate the sump area.

5. The base structure of claim 4, wherein the drain ramp further comprises:
- a first sloped surface that slopes downward in a first direction; and
- a second sloped surface that slopes downward in a second direction.

6. The base structure of claim 5, wherein the second direction is substantially perpendicular to the first direction, and wherein a sloped channel extends to the low end proximate the sump area.

7. The base structure of claim 2, wherein the blower passage extends from the heat exchanger to a blower channel outlet, and wherein the opening in the blower passage is disposed proximate the blower channel outlet.

8. A base structure for an appliance comprising:
- a drain ramp, the drain ramp configured to evacuate condensate from a heat exchanger;
- a sump area connected to the drain ramp for collecting the evacuated condensate;
- a blower channel, wherein the blower channel is configured to move dry air through an airflow path that includes the heat exchanger; and
- an air channel extending between the sump area and the blower channel, wherein the air channel is configured to provide air flow communication between the sump area and the blower channel.

9. The base structure of claim 8, wherein the air channel comprises:

a first terminal end at an opening in the blower channel; and a second terminal end at an opening in the sump area.

10. The base structure of claim 8, wherein the air channel comprises:

a bottom surface having an aperture forming a pass-through to the sump area; and a top surface forming a pass-through to the blower channel.

11. The base structure of claim 8, wherein the drain ramp comprises:

a high end proximate the heat exchanger; and a low end proximate the sump area.

12. The base structure of claim 11, wherein the drain ramp further comprises:

a first sloped surface that slopes downward in a first direction; and a second sloped surface that slopes downward in a second direction, wherein the second direction is substantially perpendicular to the first direction, and wherein a sloped channel extends to the low end proximate the sump area.

13. The base structure of claim 9, wherein the blower channel extends from the heat exchanger to a blower channel outlet, and wherein the opening in the blower channel is disposed proximate the blower channel outlet.

14. The base structure of claim 9, wherein the air channel is a labyrinth structure between the first terminal end and the second terminal end.

15. The base structure of claim 8, further comprising:

a lower base portion that defines a bottom portion of the air channel; and a top portion that defines a top surface of the air channel.

16. The base structure of claim 15, wherein the top portion couples with the lower base portion to define the air channel.

17. The base structure of claim 2, wherein the air channel is a labyrinth structure between the first terminal end and the second terminal end.

18. The base structure of claim 1, further comprising:

a lower base portion that defines a bottom portion of the air channel; and a top portion that defines a top surface of the air channel.

19. The base structure of claim 18, wherein the top portion couples with the lower base portion to define the air channel.

20. The base structure of claim 1, wherein the drain ramp is a gravity-assisted drain structure having a high area and a low area proximate the sump area.

* * * * *